United States Patent [19]

van Laarhoven

[11] 4,363,622

[45] Dec. 14, 1982

[54] COMBUSTION FLASHBULB

[75] Inventor: Aloysius M. M. van Laarhoven, Tilburg, Netherlands

[73] Assignee: U.S. Philips Corporation, New York, N.Y.

[21] Appl. No.: 46,538

[22] Filed: Jun. 7, 1979

[30] Foreign Application Priority Data

Jun. 20, 1978 [NL] Netherlands ..... 7806616

[51] Int. Cl.[3] ..... F21K 5/02

[52] U.S. Cl. ..... 431/362; 431/359; 431/358

[58] Field of Search ..... 431/357, 358, 359, 361, 431/362, 365

[56] References Cited

U.S. PATENT DOCUMENTS

| | | | |
|---|---|---|---|
| 3,501,254 | 3/1970 | Nijland et al. | 431/359 |
| 3,884,615 | 5/1975 | Sobieski | 431/362 |
| 4,101,260 | 7/1978 | Wanninkhof | 431/359 |
| 4,128,858 | 12/1978 | Sterling et al. | 431/362 |
| 4,133,630 | 1/1979 | Vreeswijk et al. | 431/359 |
| 4,174,944 | 11/1979 | Newell et al. | 431/359 |
| 4,190,413 | 2/1980 | Shaffer et al. | 431/362 |
| 4,204,834 | 5/1980 | Fohl | 431/358 |

*Primary Examiner*—Carroll B. Dority, Jr.
*Assistant Examiner*—R. J. Marett
*Attorney, Agent, or Firm*—Robert S. Smith

[57] ABSTRACT

Combustion flashbulbs according to the invention have a light-pervious lamp envelope (1) filled with a tangled mass (5) of actinically combustible metal strips and an oxidizing gas. Current supply conductors (2, 3) are coated on parts situated within the lamp envelope with a dispersion (4) of metal powder in binder. This dispersion (4) adheres strips of the mass (5) to the current conductors (2, 3).

The bulb can be ignited by a current pulse of approximately 25 V. Another method of igniting is to produce breakdown by applying a short-lasting voltage of approximately 25 V across the conductors (2, 3), afterwards succeeded by a filament current having a voltage of approximately 10 V. If the metal in the dispersion (4) is a nobler metal, the bulbs can be ignited with a current source of 10 V without preceding breakdown.

The bulbs are simple of construction, rapid, and give a short-lasting lightflash.

3 Claims, 4 Drawing Figures

COMBUSTION FLASHBULB

The invention relates to a combustion flashbulb having a sealed vacuum-tight light-pervious lamp envelope which is filled with an oxidizing gas and a mass of actinically combustible metal strips, in which current conductors extend at a distance from each other from outside the lamp envelope through the wall thereof into the lamp envelope and are there each in contact with the mass of metal strips, said bulb having means for the electric ignition of the bulb. Such a flash bulb is disclosed in U.K. patent specification No. 961,804.

The igniting means of the known bulb consist of a filament which is connected to the current conductors and is of the same metal as that of which the strips of the mass consist. Before the current conductors are sealed in the wall of the lamp envelope the filament has to be connected to said conductors. It is not only cumbersome to connect the thin filament to the comparatively thick current conductors, but the resulting assembly is so fragile that the current conductors have to be united by means of a glass bead to form an assembly which can readily be handled. The bulb is ignited by applying a voltage of 3 V.

As compared with other known bulbs, the known bulb has the advantage of being igniting-paste-free. Therefore, in manufacturing the bulb—the critical step of providing the correct quantity of paste is absent. Variations in the quantity of paste as a matter of fact involve variations in the light-technical properties of the bulb. As a result of the absence of igniting paste the manufacturing process is safer and more rapid, the possibility of spontaneous ignition of the bulb is smaller and the light flux is larger because less blackening of the bulb envelope occurs upon igniting the bulb.

Since photocameras become lighter and lighter in weight, the possibility of blurring due to motion increases when conventional flashbulbs are used which require a shutter time of approximately 25 msec. It is therefore desirable to have faster flashbulbs which give a flash of a short duration.

Figure 2:
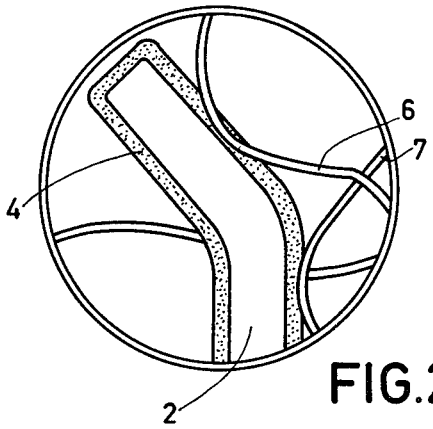

As appears from FIG. 2 of the above-mentioned British Patent Specification, the igniting-paste-free bulb described therein has reached its highest luminous flux only approximately 20 msec after applying the igniting voltage, as have conventional bulbs with which said bulb was compared. Another 15 msec later the luminous flux has decreased only to 50% of its highest value.

It is the object of the invention to provide a considerably faster combustion flashbulb which gives a flash of a shorter duration and in addition is much simpler in construction.

In agreement herewith the invention relates to a combustion flashbulb of the kind mentioned in the first paragraph which is characterized in that the current conductors inside the lamp envelope are coated at least locally with a dispersion of a metal powder in a binder and that the igniting means of the bulb consist of the current conductors and a part of the mass of metal strips, which part is adhered to the current conductors by means of the dispersion of metal powder in binder.

As for the known bulb, the bulb according to the invention also comprises no igniting paste.

It is to be noted that a further combustion flashbulb of the kind described in the first paragraph of this specification is described in the non-prepublished Netherlands patent application No. 7714304 (PHN 8999), in which the igniting means also consist of the current conductor, and a portion of the mass of metal strips. This bulb has a resistance of more than $10^8$ Ohm between the current conductors. This very high resistance is caused by the oxide skin which is always present on actinically combustible metals, such as zirconium, after contact with oxygen. This bulb can be ignited in by either of two methods. The first method is to produce a breakdown through the mass by means of a voltage pulse of 25 V or more having an energy content of 30 to 40 $\mu$J just sufficient to break down the oxide skin, for example, a piezo pulse (a "filament" being formed between the current conductors in the mass and the resistance between the current supply conductors decreasing to a value of 20 to 50 Ohm) and to cause then the "filament" to glow by applying a voltage. For this purpose a voltage of 10 to 15 V is sufficient; The second method is to apply a voltage pulse of 25 V or more having an energy content of approximately 2 mJ. Breakdown through the mass and glowing of the "filament" formed takes place, which then results in combustion of the bulb contents.

In the bulb according to the said prior patent application the "filament" formed upon breakdown is extremely weak mechanically so that the filament, to ignite the bulb, must be made to glow immediately after breakdown, i.e. the second method is to be preferred.

In contradistinction thereto, when in the bulb according to the invention breakdown is produced, the "filament" formed is resistant to mechanical shocks to a high extent, even to such an extent that the oxide skin can be broken down already during the manufacture to form a low-ohmic "filament". The bulb can then be ignited by the user by means of a current source having a terminal voltage of 10 to 15 V. For the breakdown a short-lasting pulse (for example, lasting 10–20 $\mu$sec) of 25 V or more may be used. Breakdown can be produced, for example, by means of a piezo pulse.

It has surprisingly proved possible by using a dispersion of a nobler metal to obtain bulbs which have a very low ohmic resistance between the current conductors without preceding breakdown. (Nobler metal is to be understood to mean herein a metal which produces no or nocoherent oxide skin upon exposure to air at room temperature.) The metals showing this effect include nickel, tungsten, silver, gold, platinum. The first two are to be preferred from an economic point of view. The bulbs can be ignited by connecting a current source having a terminal voltage of 10 to 15 V.

The bulb according to the invention is surprisingly fast. The highest luminous flux can be obtained well within 10 msec after connecting a voltage source which provides a filament current. Further approximately 15 msec after connecting the source, the luminous flux has already reduced to half of its maximum value.

The bulb according to the invention can more easily be manufactured than the bulb disposed in said U.K. patent. No filament need be assembled in the bulb. As a result of this the current conductors need not be united by means of a glass bead to form an assembly.

After having sealed the current conductors in the wall of the lamp envelope, at least a part of the portions of said conductors extending inside the bulb envelope which is still open at the other end is covered with a dispersion of a metal powder in a solution of a binder. This can be done in a simple manner by dipping the conductors in such a dispersion. A mass of actinically combustible metal strips is then provided in the lamp envelope, for example, by blowing strips into the lamp envelope, the mass being formed in the lamp envelope. Strips of a portion of the mass come in contact with the still wet dispersion. It is assumed that, according as the dispersion further dries, the strips which are in contact with the dispersion are attracted more strongly against the current conductors by capillary forces. As a result of this a good fixation of the strips to the current conductors is obtained.

In contrast with the igniting paste of conventional bulbs, the quantity of dispersion which is provided on the current conductors is not critical. A coating in a location where the mass engages the current conductors is sufficient.

After providing the mass of metal strips in the lamp envelope, the latter is filled with an oxidizing gas, for example oxygen, and sealed.

Organic polymeric compounds are used in the dispersion as binders. As examples are mentioned: cellulose acetate butyrate, acrylate resin, hydroxyethyl cellulose, nitrocellulose. As solvents may be used, inter alia: butyl lactate, ethyl lactate, diacetone alcohol, ethylglycol, cyclohexanone, butyl acetate.

The metal powder used generally has a particle size of from 1 to 20 μm, as a rule from 5 to 10 μm.

It has been found that the metal powder has a favourable influence on the resistance against mechanical shocks of the "filament" formed upon breakdown. It has furthermore been found that the binder in the presence of a metal powder, for example aluminium, magnesium, can better withstand the higher temperatures to which the bulb is subjected when the open end of the lamp envelope is narrowed before it is sealed.

It is recommendable for the current conductors to extend in the lamp envelope over some distance. In the case of elongate bulbs, such as the presently current tubular bulbs, the current conductors extend therein from one end, for example, over a distance up to ⅓ of the length of the lamp envelope. This stimulates the velocity with which the combustion front propagates through the whole bulb.

The mutual distance between the current conductors may be chosen between wide limits, for example, between a few tenths of a millimeter to a few millimeters. The current conductors are preferably bent outwards (i.e. away from each other) at their free ends so that the metal strips, when they are introduced in the lamp envelope through an aperture opposite to the current conductors, readily contact the current conductors.

The metal strips which are used in the bulb are generally cut from, for example, zirconium foil or halnium foil of from 10 to 30 μm thickness. The width of the strips is usually chosen between the same limits, while the length may vary from a few millimeters to some ten cms. Generally, the longer strips will be chosen having transverse dimensions of 15×15 to 20×30 μm.

A flashbulb according to the invention may be used in a flash unit which is provided with a new flashbulb after each flash, or in a flashbulb unit having several bulbs which are moved in the igniting position mechanically or electrically. The invention also relates to the latter unit.

Embodiments of the invention will now be described in greater detail with reference to the drawing and the examples. In the drawing FIG. 1 is a front elevation of a flashbulb according to the invention, FIG. 2 is a sectional view of a detail of the bulb on an enlarged scale, FIG. 3 shows the electric circuit diagram of a flashbulb unit having bulbs as shown in FIG. 1, and FIG. 4 is a perspective view of a flashbulb unit having bulbs as shown in FIG. 1.

Figure 1:
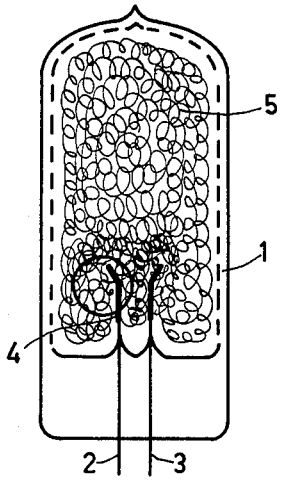

In FIG. 1, current conductors 2 and 3 extend beside each other in a vacuum-tight manner through the wall of a lamp envelope 1. The current conductors are coated with a dispersion 4 of a metal powder in a binder. The ends of the current conductors are bent apart. A mass 5 of actinically-combustible metal strips is present in the lamp envelope.

FIG. 2 shows a part of the current conductor 2 coated with the dispersion 4. The metal strips 6 and 7 are adhered to the current conductor 2 by the dispersion 4.

Figure 3:
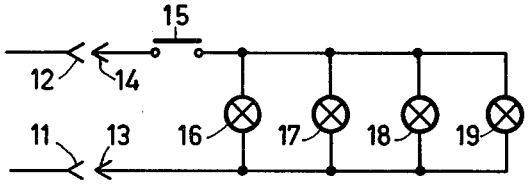
Figure 4:
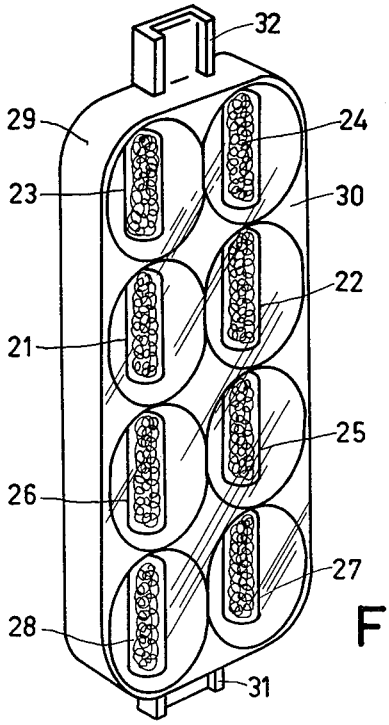

Reference numerals 11 and 12 in FIG. 3 denote the output terminals of a current source, 13 and 14 denote the input terminals of a flashbulb unit. Bulbs 16, 17, 18 and 19 are connected mutually in parallel. When the switch 15 is closed for a short instant, the bulb having the lowest breakdown voltage is ignited. When the switch is operated for the second time, the bulb which then has the lowest breakdown voltage will be fired, and so on.

The flashbulb unit shown in FIG. 4 has eight flashbulbs, 21 to 28, of the kind shown in FIG. 1. The bulbs are incorporated in a housing 29 having a transparent cover 30. The unit has two members 31 and 32 with which it can be mechanically coupled to a camera and can be connected electrically thereto. When the unit is connected to a camera via member 31, the bulbs 21 to 24 can be ignited, when coupled via member 32, the bulbs 25 to 28 can be fired.

EXAMPLE

Two current conductors of nickel-plated copper-clad wire (diameter 0.4 mm) were sealed at a mutual distance of 1.6 mm in a glass tube having an inside diameter of 7.4 mm. At their ends situated within the lamp envelope the current conductors were bent apart. These ends were then dipped in a dispersion of metal powder in a solution of a binder in a solvent which was incorporated in a vessel having an outside diameter of 7.2 mm. Immediately after providing the dispersion, 20 mg of zirconium strips having dimensions of 0.02×0.02×104 mm were provided in the tube. After evaporating the solvent the open end of the tube was drawn to a capillary after which the tube was filled with 7 bar oxygen and then sealed. The resulting bulb had a volume of 0.63 ml. The current conductors extended to over ⅓ of the length of the lamp envelope therein. Examples of dispersions which were used are:

(a) 20 mg of silver powder in 16 mg of a solution of 12 mg of cellulose acetate butyrate in 124 mg of cyclohexanone
(b) 10 mg of magnesium powder in 15 mg of this solution
(c) 10 mg of aluminium powder in 12 mg of this solution
(d) 10 mg of nickel powder. 0.4 mg of cellulose acetate butyrate, 3.1 mg of butyl lactate
(e) 10 mg of tungsten powder, 0.35 mg of cellulose acetate butyrate, 3.65 mg of cyclohexanone.

The resistance between the current conductors of the bulbs was measured. The bulbs having dispersions (b) and (c) were broken down by means of a piezo pulse, after which the resistance between the current conductors was determined again. After 5 days, all bulbs were subjected to a droptest, after which the resistance measurement was repeated.

In the following Table the measured values are stated and compared with those of reference bulbs without coating on the current conductors.

TABLE

| dispersion | R prior to breakdown (Ohm) | R after breakdown (Ohm) | R after drop test (Ohm) |
|---|---|---|---|
| a | 1.5–10 | — | 1.5–14.5 |
| b | 20–>$10^8$ | 20–65 | 20–120 |
| c | 50–>$10^8$ | 40–120 | 60–200 |
| d | 4–50 | — | 5–65 |
| e | 4–30 | — | 5–40 |
| ref | >$10^8$ | 20–50 | $10^8$ |

The results show that the bulbs with dispersions (b) and (c), which initially have a very large spread in the resistance values, obtain a low resistance upon breakdown.

After the drop test the resistance values are slightly higher but sufficiently low, far below a limit value of approximately 2000 Ohm, to enable ignition with a current source of 10 to 15 V.

What is claimed is:

1. A combustion flashbulb having a sealed vacuum-tight light-pervious lamp envelope which is filled with an oxidizing gas and a mass of actinically-combustible metal strips, in which current conductors extend at a distance from each other from outside the envelope through the wall thereof into the lamp envelope and are there each in contact with the mass of metal strips, said bulb having means to electrically ignite the bulb, characterized in that the current conductors inside the lamp envelope are coated at least locally with a dispersion of a metal powder in a binder and that the igniting means of the bulb consist of the current conductors and a part of the mass of metal strips, which part is adhered to the current conductors by means of the dispersion of metal powder in a binder.

2. A combustion flash-bulb as claimed in claim 1, characterized in that the metal powder is selected from the group consisting of nickel, tungsten, silver, gold and platinum.

3. A flashbulb unit having several combustion flashbulbs, characterized in that flashbulbs as claimed in claim 1 or 2 are incorporated therein.

* * * * *